US005584267A

United States Patent [19]

Muir

[11] Patent Number: 5,584,267

[45] Date of Patent: Dec. 17, 1996

[54] LATCHABLE ROCKER ARM MOUNTING

[75] Inventor: Darryl J. Muir, Bellevue, Mich.

[73] Assignee: Eaton Corporation, Cleveland, Ohio

[21] Appl. No.: 575,651

[22] Filed: Dec. 20, 1995

[51] Int. Cl.[6] ..... F01L 1/18; F02D 13/06

[52] U.S. Cl. ..... 123/90.39; 123/90.41; 123/198 F

[58] Field of Search ..... 123/90.15, 90.16, 123/90.39, 90.41, 90.43, 90.44, 90.46, 198 F

[56] References Cited

U.S. PATENT DOCUMENTS

| | | | |
|---|---|---|---|
| 5,203,289 | 4/1993 | Hara et al. | 123/90.16 |
| 5,386,806 | 2/1995 | Allen et al. | 123/90.16 |
| 5,413,071 | 5/1995 | Paul et al. | 123/90.16 |
| 5,435,276 | 7/1995 | Nakamura et al. | 123/90.16 |

*Primary Examiner*—Weilun Lo
*Attorney, Agent, or Firm*—Frank M. Sajovec

[57] ABSTRACT

An improved mounting for a latchable rocker arm assembly. A pivot bar is received transversely through a first rocker arm and is engageable with the output member of a hydraulic lash adjuster or other pivot member. The pivot bar has a convex arcuate upper surface engageable with a concave bearing surface formed on the second arm and a spherical socket formed in its bottom surface, the spherical socket being engageable with a spherical end formed on the pivot member. In accordance with other aspects of the invention the pivot bar serves as an anchor point for ends of a torsion spring biasing the rocker arm assembly in a latched position and has a hole formed therein which in combination with a hole formed in the second rocker arm and an oil port formed in the pivot member provides a conduit directing lubricating oil to an area of the second rocker arm which receives a roller bearing assembly.

7 Claims, 2 Drawing Sheets

LATCHABLE ROCKER ARM MOUNTING

The present invention relates to a system for varying the operational characteristics of intake or exhaust valves in an internal combustion engine during various operational modes of the engine and more particularly to an improved mounting assembly for such system.

Variable valve control systems for multiple valve engines wherein in the intake and/or exhaust valves can either be selectively actuated and deactuated or actuated at selected lift profiles, are well known in the art. One known system is shown in U.S. Pat. No. 4,151,817, which discloses a primary rocker arm element engageable with a first cam profile, a secondary rocker arm element engageable with a second cam profile, and means to interconnect or latch the primary and secondary rocker arm elements.

U.S. patent application Ser. No. 412,474 filed Mar. 28, 1995 and U.S. patent application Ser. No. 439,531 filed May 11, 1995, which are incorporated herein by reference, disclose a system of the above type which is specifically operable to selectively actuate or deactuate an engine valve and which comprises a latchable rocker arm assembly including an inner rocker arm having a roller which contacts the cam; an outer rocker arm which engages the valve, the inner and outer arms being in nesting relation to one another and in pivotal contact with a pivot point on the cylinder head of the engine, which pivot point can be the output plunger of a stationary lash adjuster; and a sliding latch member which is moveable between an active position wherein the inner and outer arms are effectively latched together and operable to actuate the valve, and an inactive position wherein the inner and outer arms are free to move relative to one another and the valve is not actuated. The assembly further includes a biasing spring acting between the inner and outer arms to bias the inner arm into engagement with the cam and the outer arm into engagement with the valve, the relationship between inner and outer arms being effective to counteract the plunger spring and hydraulic forces of the lash adjuster to insure that the lash adjuster does not pump up when the rocker arms are in their unlatched condition.

In the system described above, one of the nested rocker arms is pivotally mounted directly on a pivot point and the second rocker arm is pivotally mounted on the first rocker arm. In a preferred embodiment the pivot point is the output plunger of a stationary hydraulic lash adjuster and the pivotal mounting is by means of arcuate bearing surfaces formed between the output plunger and one rocker arm and between the two rocker arms.

While the above is a satisfactory configuration for the rocker arm assembly: since the rocker arms are rather complex formed shapes which are preferably fabricated using a cold forming process, with the arcuate bearing surfaces formed by coining: it is difficult to accurately and economically coin both bearing surfaces required on one rocker arm, specifically a concave surface engageable with the lash adjuster plunger and a convex surface engageable with a corresponding concave surface on the other rocker arm.

To overcome the above problem the present invention provides an improvement to the original design wherein the arcuate bearing surfaces of the first rocker arm are formed on a separate pivot bar element which is assembled to the formed rocker arm. The use of a separate element greatly simplifies the coining process while providing a more accurate relationship among the first and second rocker arms and the output member of the lash adjuster.

A further improvement provided by the invention is the inclusion of means to supply lubricating oil to the needle roller assembly which defines the cam follower of a preferred embodiment of the rocker arm system described above. This is accomplished by providing oil passages in the pivot bar and in the rocker arms in the area of the pivot points, in communication with a port formed in the lash adjuster plunger which meters oil from the lash adjuster oil supply, and to provide a channel for the oil extending from the pivot area to the roller assembly.

Other objects and advantages of the invention will be apparent from the following description when considered in connection with the accompanying drawings, wherein.

Figure 1:
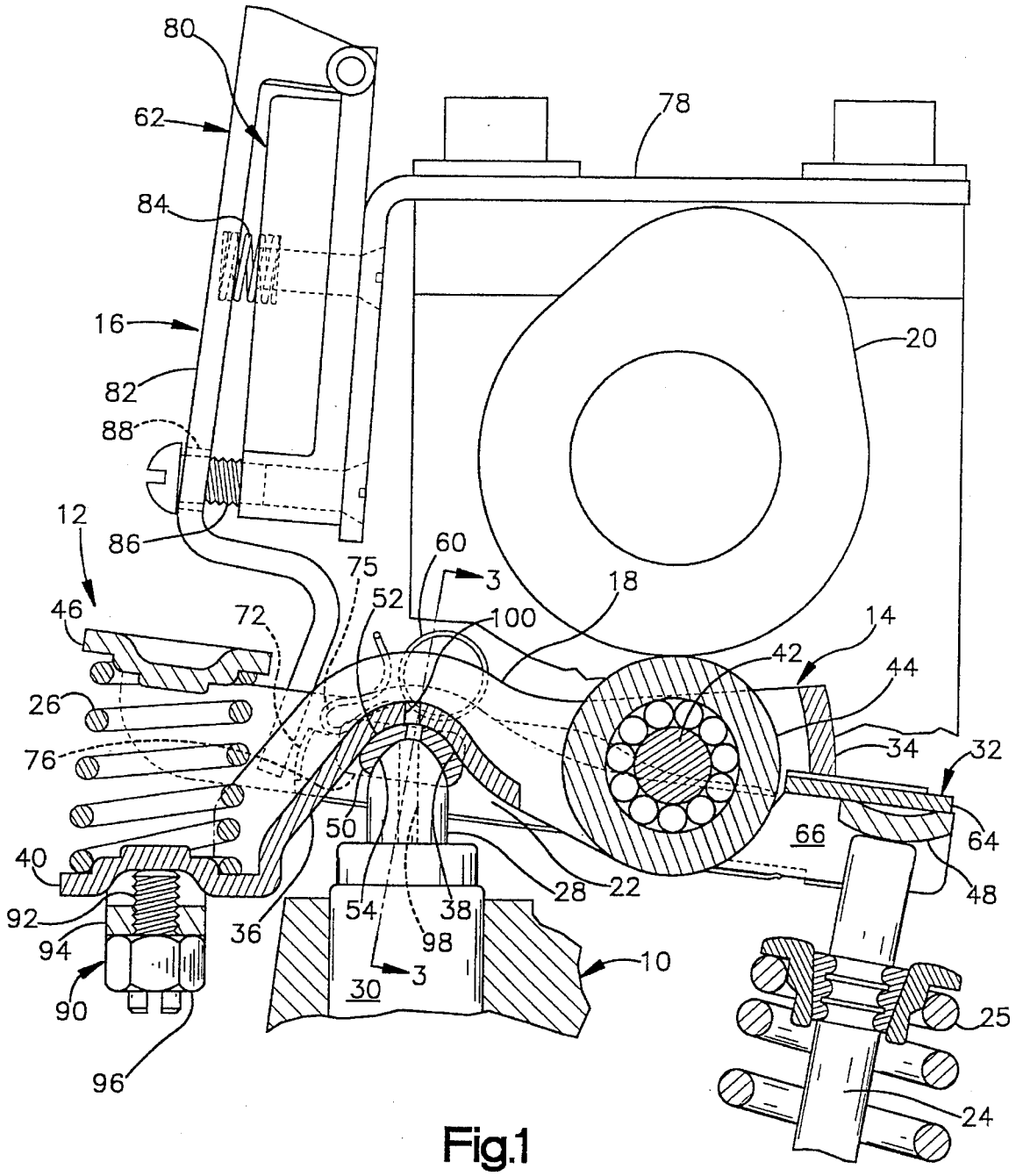
FIG. 1 is a cross-sectional view of a latchable rocker arm system incorporating the invention.
Figure 2:
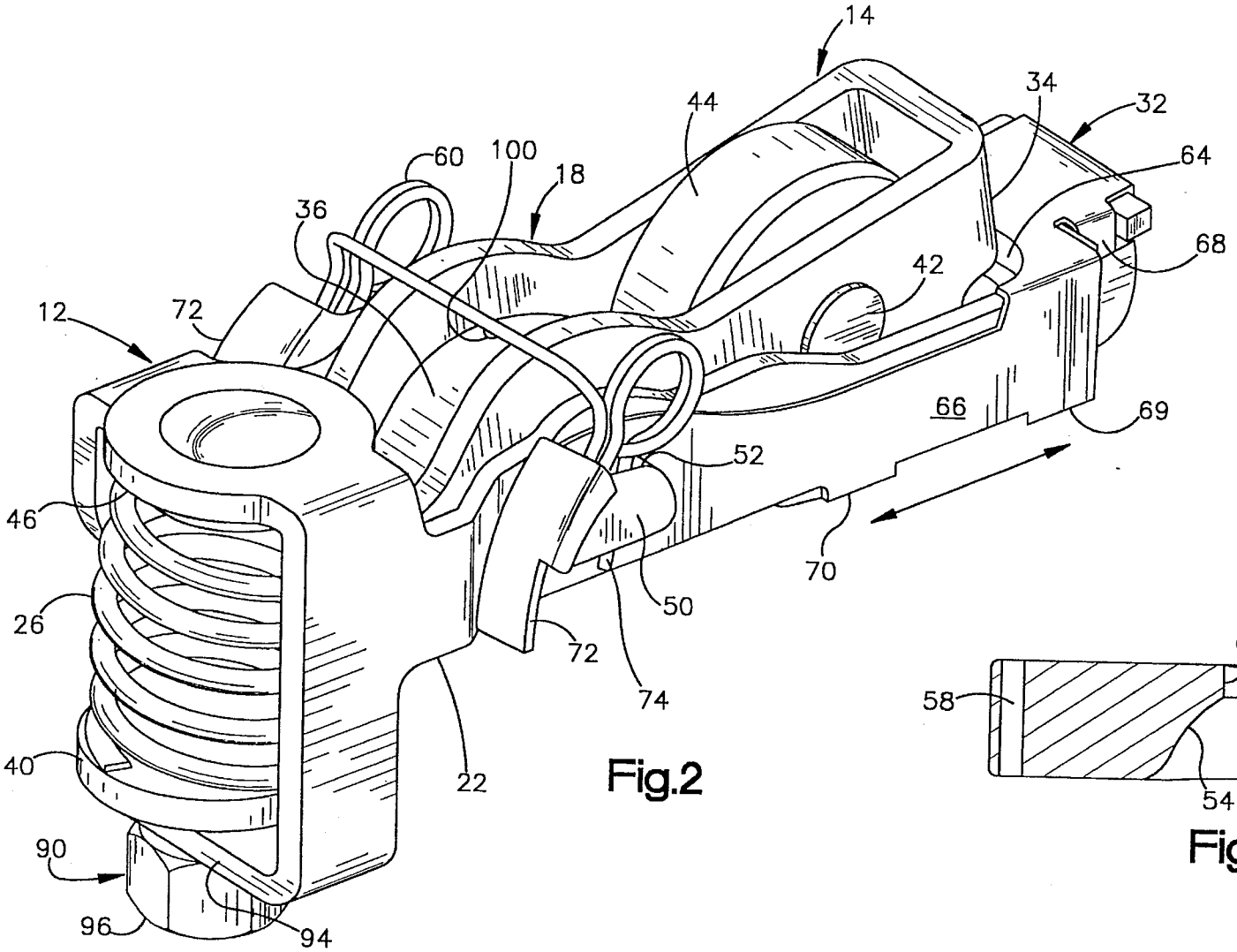
FIG. 2 is an oblique view of the rocker arm system of FIG. 1.

Referring primarily to FIGS. 1 and 2, there is illustrated a portion of the cylinder head 10 of an internal combustion engine of the overhead cam type which incorporates the valve control system 12, of the invention. As illustrated herein, the control system 12 is of the type which is particularly adapted to selectively actuate or deactuate an engine valve and comprises a rocker arm assembly 14 which is shiftable between an active mode wherein it is operable to open the valve, and an inactive mode wherein the valve is not opened; and an actuator assembly 16 which is operable to shift the rocker arm assembly between its active and inactive modes.

The rocker arm assembly 14 comprises an inner arm assembly 18 which is engageable with the valve actuating cam 20 of the engine, an outer arm 22 which is engageable with a poppet valve 24 which is maintained normally closed by a spring 25, a biasing spring 26 which acts between the inner and outer arms to bias the inner arm into engagement with the cam 20 and the outer arm into engagement with the plunger 28 of a stationary lash adjuster 30, as well as with the valve 24, and a latch member 32 which is slidably received on the outer arm and which is effective to latch the inner and outer arms together to define the active mode of the control system or to unlatch them to define the inactive mode. In the preferred embodiment of the invention the outer arm 22 is pivotally mounted on the plunger 30 and the inner arm 18 is pivotally mounted on the outer arm 22. The construction and the function of the lash adjuster 30 are well known and will not be described in detail herein. It will also be apparent that the rocker arm assembly can be mounted on a fixed pivot point or lash adjustment means other than a hydraulic lash adjuster.

The inner arm 18 is preferably a generally U-shaped stamped structure, having spaced apart walls, a contact element 34 at the base of the U, and a central spine section 36. The spine section 36 defines the pivot point of the arm in the form of a concave bearing surface 38 which contacts the outer arm as will be described below, and a spring receiving element 40. Aligned bores are formed in the walls to receive the axle 42 of a needle roller assembly 44. As will be descried in more detail below, the contact element 34 defines a latch surface which interacts with the outer arm 22 and the latch member 32.

The outer arm 22 is a generally rectangular member in plan view having spaced apart side walls, a first end portion 46 defining a spring receiving element, and a second end portion 48 defining a valve contacting pad.

Figure 3:
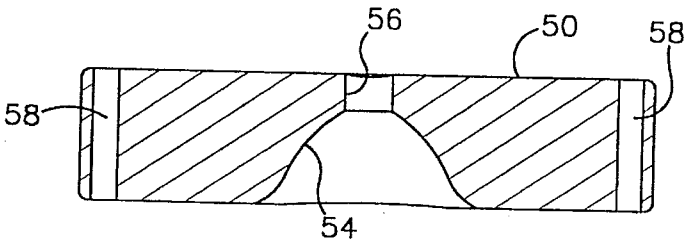
FIG. 3 is a sectional view of the pivot member of the invention taken along line 3—3 of FIG. 1.

In accordance with the invention a pivot bar 50 is received through openings formed in the side walls of the outer arm 22 and defines the bearing surfaces in engagement with the plunger 28 and the inner arm 30. The pivot bar is a elongated member having an arcuate upper surface 52 (in end view) which defines a pivot surface for the bearing surface 38 of the inner arm, a flat bottom surface, and (referring to FIG. 3) has a centrally located generally spherical socket 54 which defines a concave bearing surface in engagement with the ball end of the plunger 28. As will be described in more detail below, an oil port 56 is formed through the socket portion, and holes 58 are formed adjacent the ends to retain the ends of an actuator biasing spring 60.

When the system 12 is assembled, the inner and outer arms are nested together as most clearly shown in FIG. 2. The needle roller assembly 44 is received between the walls of the inner arm with the roller axle 42 having a slip fit within the bores formed in the walls, the adjacent walls of the inner and outer arms being arranged such that the axle 42 is always in contact with the walls of the outer rocker arm during operation such that no positive retention means such as staking is required for retention.

When the assembled rocker arms are installed in the engine the socket portion 54 of the pivot bar 50 is positioned over the plunger 28 of the lash adjuster 32, which places the roller assembly 44 of the inner arm 18 in contact with the cam 20 and the contact pad 48 of the outer arm 22 in contact with the valve 24. The spring 26 is received over the elements 40 and 46 between the inner and outer arms to bias the inner arm 18 into engagement with the cam 20 (via the roller 48) and the outer arm 22 into engagement with the valve 24 and with the plunger 30.

The control system 12 is shifted between its active and inactive modes by means of the actuator assembly 16, which includes the latch assembly 32 and an actuator 62.

In the embodiment illustrated herein the latch assembly comprises a flat plate 64 which slides along the top surface of the outer arm and which is engageable with the contact element 38 of the inner arm. The plate 64 is maintained in its latched position on the outer arm by a slide member 66 which straddles the outer arm. Referring to FIG. 2, the slide member is a sheet metal part which has a first pair of tabs 68 (only one visible in FIG. 2) which are bent over the plate for retention, second and third pairs of tabs 69, 70 (one each visible in FIG. 2) which maintain the slide member in position to slide along the outer arm in the direction of the arrow and a pair of outwardly directed ears 72 which are engaged by the actuator assembly 16. The latch assembly is biased into a normally engaged position by the actuator spring 60, which is a hairpin type torsion spring having a pair of ends 74 inserted into the holes 58 of the pivot bar and a pair of loops 75 in engagement with the back sides of the ears 72 (see FIG. 1). Slots 76 in the slide member permit movement past the pivot bar. In the illustrated embodiment the spring ends 74 are received in the bar 50 outside the respective sides of the slide member, which retains the pivot bar within the rocker arm and also serves to retain the sides of the slide member against the outside walls of the outer arm 22.

As illustrated in FIGS. 1 and 2, the latch assembly 32 is shown in its active or engaged position with the plate 64 engaged by the inner arm. In this position when the cam 20 rotates out of the base circle position shown, the force of the cam 20 on the roller 44 is transmitted to the outer arm 22 through the plate 64 and to the valve 24, moving the valve to its open position.

To shift from the active mode to the inactive mode, the latch assembly 32 is moved to the right as illustrated herein by means of the actuator 62 to slide the plate 64 out of engagement with contact element 34 of the inner arm. With the latch disengaged, the force of the cam against the inner arm is transmitted to the spring 26 rather than to the outer arm, and the valve remains in its closed position.

In the illustrated embodiment, the actuator 62 is shown somewhat schematically since a variety of actuating arrangements can be used to shift the latch member assembly 32, and the actual arrangement employed will depend on space and mounting limitations associated with a particular engine in which the system is installed. As shown herein the actuator 62 comprises a bracket member 78 suitably attached to the engine, an electromagnet assembly 80 attached to the bracket, and a plate 82 which is pivotally mounted on the magnet frame and which rotates counter clockwise as viewed in FIG. 1 when the electromagnet is energized. The free end of the plate 82 is forked (not shown) to engage the ears 72 of the slide member and move the actuating assembly 32 to the right as shown to shift the rocker arm assembly from its active position to its inactive position. A compression spring 84 acting between the electromagnet assembly and the plate 82 biases the plate into the position shown in FIG. 1. A screw 86 received through a clearance hole 88 in the plate 82 and threaded into the magnet assembly provides a stop to set the angular position of the plate and limit clockwise movement.

As illustrated herein the rocker arm assembly includes an adjusting assembly 90 which permits the precise setting of the maximum clearance between the contact element 34 and the plate 64. The adjusting assembly comprises a screw 92 which is threaded through a portion 94 of the outer arm 22 which extends beneath the spring receiving element 40 of the inner arm and bears against it. A lockout 96 maintains the adjusted position of the screw.

In accordance with another aspect of the invention means are provided to insure adequate lubrication of the roller bearing assembly 44. In accordance with common practice in hydraulic lash adjuster design a metered oil port 98 is formed in the plunger 28 communicating with oil galleries (not shown) in the head 10 which supply oil to the lash adjuster 30. The hole 56 in the pivot bar and a hole 100 formed in the spine 36 of the outer arm provide a flow path for metered oil from the plunger 30 to the area between the walls of the inner arm 18 adjacent to the roller assembly 44.

I claim:

1. In a valve control system for an internal combustion engine including a cylinder head, a poppet valve, and a camshaft having a cam lobe formed thereon; said control system comprising a first rocker arm engageable with said poppet valve; a second rocker arm engageable with said cam lobe; means for mounting said first and second rocker arms on said cylinder head for pivotal movement relative to said cylinder head and relative to one another; means biasing said first rocker arm into engagement with said poppet valve and said second rocker arm into engagement with said cam lobe; and means for selectively interconnecting said first and second rocker arms for rotation in unison in response to a force applied by said cam lobe to said second rocker arm; the improvement wherein said means for mounting said first and second rocker arms comprises a pivot member received on said first rocker arm, said pivot member having a concave bearing surface formed thereon and a convex bearing surface formed thereon, and said second rocker arm having a concave bearing surface formed thereon in engagement with the convex bearing surface of said pivot member.

2. Apparatus as claimed in claim 1, in which said pivot member comprises an elongated bar having a convex arcuate top surface, a generally flat bottom surface, and a substantially spherical socket formed in said bottom surface, said top surface being engageable with the concave bearing surface of said second rocker arm.

3. Apparatus as claimed in claim 2, including a lash adjuster received in said cylinder head, said lash adjuster having a spherical pivot surface formed thereon; said spherical socket being in engagement with said spherical pivot surface.

4. Apparatus as claimed in claim 1, in which said means for selectively interconnecting said first and second rocker arms comprises a latch member in sliding engagement with said first rocker arm and movable between a first position wherein it is engaged by said second rocker arm in response to said cam force and a second position wherein it is not engaged by said second rocker arm.

5. Apparatus as claimed in claim 4, including spring means biasing said latch member towards said first position; said spring means comprising a wire spring having two spaced apart free ends, said free ends being received in holes formed in said pivot bar adjacent opposite ends thereof.

6. Apparatus as claimed in claim 3, in which said pivot member has a hole therethrough in the area of said socket; and said second rocker arm has a hole formed therethrough in the area of said concave bearing surface; and said lash adjuster has an oil port formed in the area of said spherical pivot surface; said hole in said pivot member, said hole in said second rocker arms, and said oil pod being in substantial alignment.

7. Apparatus as claimed in claim 4, including a slide member retaining said latch member, said slide member comprising a thin sheet member having opposed walls in sliding engagement with opposed walls of said first rocker arm and having slots formed therein to provide clearance for said pivot bar, the holes in said pivot member receiving said spring ends being located outside the opposed walls of said slide member.

* * * * *